US008261719B2

(12) United States Patent
Langenbach et al.

(10) Patent No.: US 8,261,719 B2
(45) Date of Patent: Sep. 11, 2012

(54) FUEL PUMP, IN PARTICULAR FOR A FUEL SYSTEM OF A PISTON ENGINE

(75) Inventors: Christian Langenbach, Burgstetten (DE); Manfred Fink, Ilsfeld (DE); Armin Merz, Weinstadt (DE); Josef Guentert, Gerlingen (DE); Jan Grebe, Starnberg (DE); Robert Reitsam, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 257 days.

(21) Appl. No.: 12/677,600

(22) PCT Filed: Sep. 1, 2008

(86) PCT No.: PCT/EP2008/061470

§ 371 (c)(1),
(2), (4) Date: Mar. 11, 2010

(87) PCT Pub. No.: WO2009/037100

PCT Pub. Date: Mar. 26, 2009

(65) Prior Publication Data

US 2010/0192921 A1 Aug. 5, 2010

(30) Foreign Application Priority Data

Sep. 18, 2007 (DE) ..... 10 2007 044 499

(51) Int. Cl.
*F02M 41/06* (2006.01)
*F02M 41/00* (2006.01)

(52) U.S. Cl. ..... 123/450

(58) Field of Classification Search ..... 123/450, 123/449, 495, 508; 417/410.3, 410.4, 410.5; 418/72

See application file for complete search history.

(56) References Cited

U.S. PATENT DOCUMENTS

| | | | | |
|---|---|---|---|---|
| 4,781,552 | A | 11/1988 | Malfit | |
| 5,028,221 | A | 7/1991 | Malfit | |
| 5,725,362 | A | 3/1998 | Zepp et al. | |
| 5,937,734 | A | 8/1999 | Stiefel et al. | |
| 2006/0093490 | A1 | 5/2006 | Kleinbeck et al. | |
| 2006/0165544 | A1 * | 7/2006 | Lettner et al. | 418/205 |
| 2008/0247896 | A1 * | 10/2008 | Cooper et al. | 418/178 |

FOREIGN PATENT DOCUMENTS

| | | | |
|---|---|---|---|
| DE | 19528631 | A1 | 2/1997 |
| DE | 19635164 | A1 | 3/1998 |
| GB | 683678 | | 12/1952 |
| GB | 769763 | | 3/1957 |
| GB | 2042083 | A | 9/1980 |
| WO | 8705975 | A1 | 10/1987 |
| WO | 2004051084 | A1 | 6/2004 |

* cited by examiner

*Primary Examiner* — Mahmoud Gimie

(74) *Attorney, Agent, or Firm* — Michael Best & Friedrich LLP

(57) ABSTRACT

A fuel pump according to the invention includes a housing and a part, which is a moving part during operation and which bears on a housing region at least indirectly. It is proposed that the fuel pump includes a coating which is applied to the housing region on a side of the housing region which faces towards the moving part, and that the coating is composed of a plastic.

36 Claims, 3 Drawing Sheets

FUEL PUMP, IN PARTICULAR FOR A FUEL SYSTEM OF A PISTON ENGINE

CROSS-REFERENCE TO RELATED APPLICATION

This application is a 35 USC 371 application of PCT/EP2008/061470 filed on Sep. 1, 2008.

BACKGROUND OF THE INVENTION

1. Field of the Invention

The invention relates to a fuel pump, in particular for a fuel system of a piston engine, as generically defined by the preamble to claim 1.

2. Description of the Prior Art

Methods and devices for vibration-damping of the handle are known. For instance, spring-loaded and/or elastically damping handles are employed. In arrangements, the handle is decoupled from the vibration-excited power tool housing via the spring/damper system. In addition, split, spring-loaded and/or damped housings are used, in order to decouple the housing from the vibration-excited components, such as the drive device.

In such pumps, at least one of the parts that is in motion in operation, such as gear wheels (in the case of a geared pump) or a rotor (in the case of a vane cell pump), rests laterally on a housing region of the fuel pump, so that in operation they slide along that housing region. For reasons of weight, the housings of the known high-pressure fuel pumps are made partly of aluminum. To ensure adequate wear resistance of the housing region along which the parts that are in motion in operation slide, these housing regions, also called "runup faces" are made for instance from steel or gray cast iron.

OBJECT AND SUMMARY OF THE INVENTION

It is the object of the invention to create a high-pressure fuel pump which has a long service life, is low in cost, and requires little space.

This object is attained by the high-pressure fuel pump according to the invention. Characteristics important to the invention are also found in the ensuing description and the drawings. The characteristics may be important for the invention both on their own and in various combinations, without explicit mention being made thereof.

The coating provided according to the invention is extremely wear-resistant and is therefore very well suited as a running face particularly for rotating parts, such as gear wheels or rotors of corresponding types of pump. The elimination of a separate running face, for instance of steel or gray cast iron or the like, such as aluminum/nickel or anodized aluminum, leads to cost savings. With the elimination of an intermediate disk of steel or gray cast iron as a running face, the space required is reduced as well; thus the high-pressure fuel pump has comparatively small dimensions. If the coating of plastic is applied directly to the housing region, without the use of a coated intermediate disk as a running face for the moving part, a sealing region toward the outside is eliminated as well, which simplifies construction, reduces costs, and increases the operating reliability.

A first refinement of the invention provides that the plastic is a thermoplastic, in particular a polyether ether ketone. Such a material is especially wear-resistant and therefore provides for a long service life of the high-pressure fuel pump.

This advantage can be enhanced further if the thermoplastic is reinforced with fibers, in particular carbon fibers.

The material of at least the housing region onto which the coating is applied includes aluminum or is aluminum. Aluminum is comparatively simple to machine, which reduces the production costs. Moreover, it has a low weight, and thus the weight of the high-pressure fuel pump is low. Nevertheless, by means of the plastic coating provided according to the invention, wear is kept slight, and a long service life of a high-pressure fuel pump that is for by far the most part made of aluminum is ensured.

The refinement of the high-pressure fuel pump of the invention in which a region of the coating is embodied as a sealing region, which cooperates with another region of the housing is especially advantageous. The plastic coating provided according to the invention performs a dual function in such a case: Besides the wear-reduced function, it also performs a sealing function. Separate sealing, for instance by means of an O-ring, including the attendant metal-cutting machining after suitable O-ring grooves have been made is thus not necessary. This too simplifies construction, facilitates assembly, reduces sources of mistakes, and so forth.

The sealing region can include an encompassing sealing bead or an encompassing sealing lip. Such embodiments are easy to produce with conventional plastics, especially thermoplastics, and ensure reliable sealing off even with major pressure differences.

The plastic coating can be produced simply in that the coating is melted onto the housing region.

It is also possible that the housing region onto which the coating is applied includes a comparatively thin support plate, which is secured to another housing region, preferably glued to it. In specific applications, depending on what until now was the complex geometry of the housing region and/or of the region to be sealed off, this makes individualized, reliable construction possible.

BRIEF DESCRIPTION OF THE DRAWINGS

Embodiments of the invention are described in further detail below in conjunction with the drawings. In the drawings.

DESCRIPTION OF THE PREFERRED EMBODIMENTS

Figure 1:
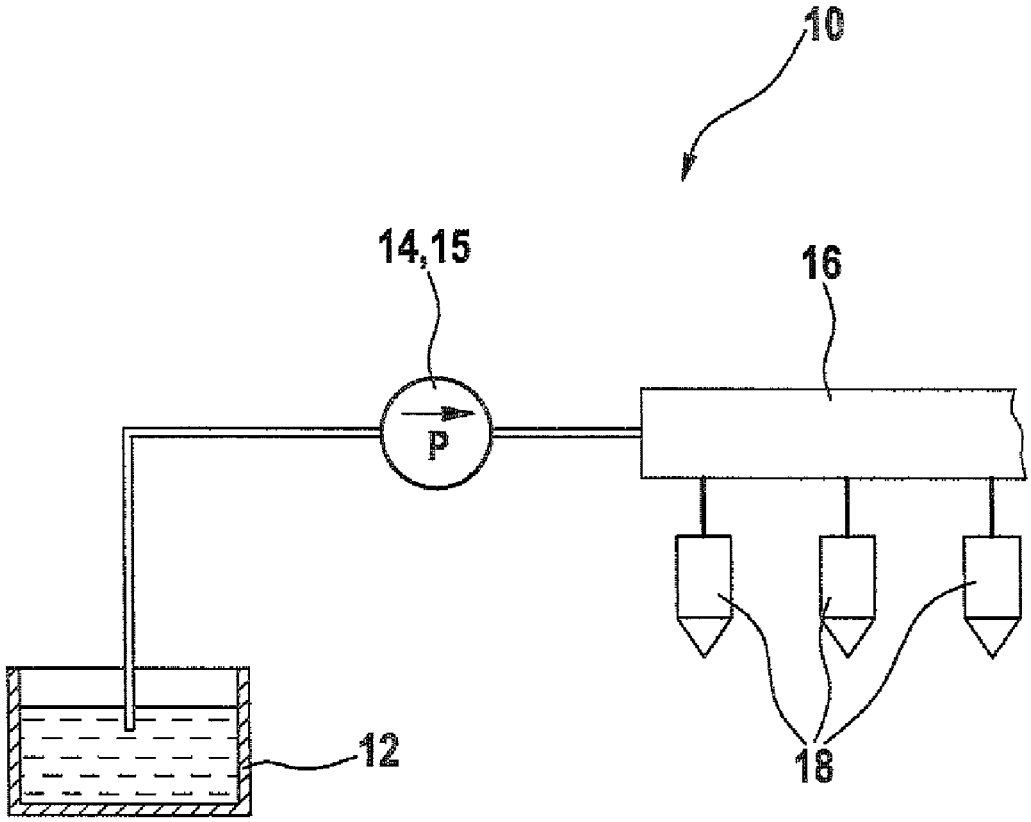
FIG. 1 is a schematic illustration of a fuel system of a piston engine with a high-pressure fuel pump.

In FIG. 1, a fuel system for a piston engine is identified overall by reference numeral 10. It includes a fuel tank 12, from which a high-pressure fuel pump 14 pumps the fuel into a high-pressure fuel reservoir ("rail") 16. A plurality of injectors 18 are connected to the rail 16 and inject the fuel directly into combustion chambers (not shown) of the engine that are associated with them.

On the low-pressure side, the high-pressure fuel pump 14 includes a geared pump 15. In exemplary embodiments not shown, the high-pressure fuel pump can also include a vane cell pump or any other suitable type of pump on its low-pressure side. The high-pressure fuel pump 14, including the geared pump 15 on the low-pressure side, is driven directly and mechanically by the engine. In an exemplary embodiment not shown, the geared pump on the low-pressure side can also have a separate drive mechanism, such as an electric motor.

Figure 2:
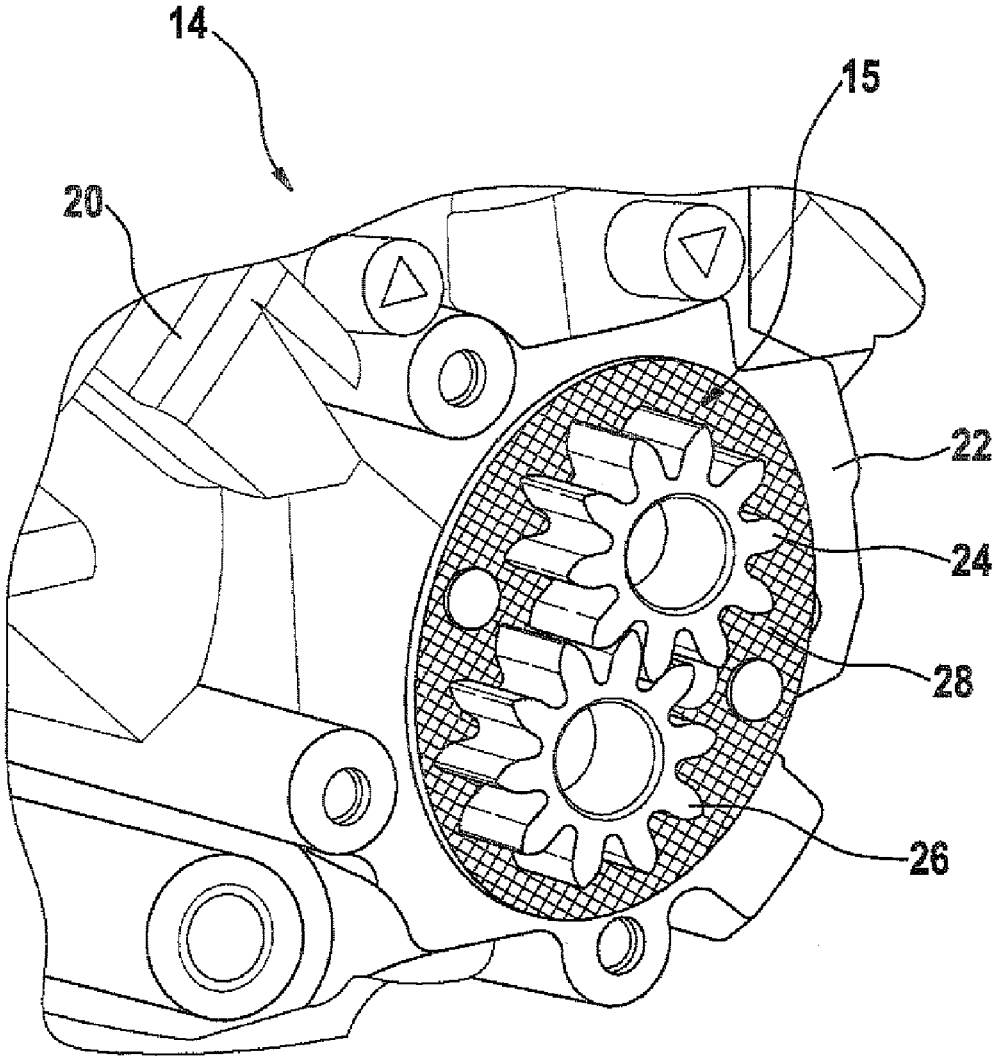
FIG. 2 is a perspective view of one region of the high-pressure fuel pump of FIG. 1.

In FIG. 2, a region of the geared pump 15 of the high-pressure fuel pump 14 is shown, but in a state in which a housing cap that is present in normal operation is removed. A housing 20 made as a cast part can be seen, which has been machined in metal-cutting fashion at various points and which contains the mechanical and fluidic components of the high-pressure fuel pump 14. The housing 20 is made from aluminum. A housing region 22 is machined as a flat face. The housing region 22 serves as a running face for two gear wheels 24 and 26, which in the operation of the high-pressure fuel pump 14 and of the geared pump 15 rotate in opposite directions. The gear wheels 24 and 26 are accordingly parts that are in motion during operation and that rest at least indirectly on the flat housing region 22.

Figure 3:
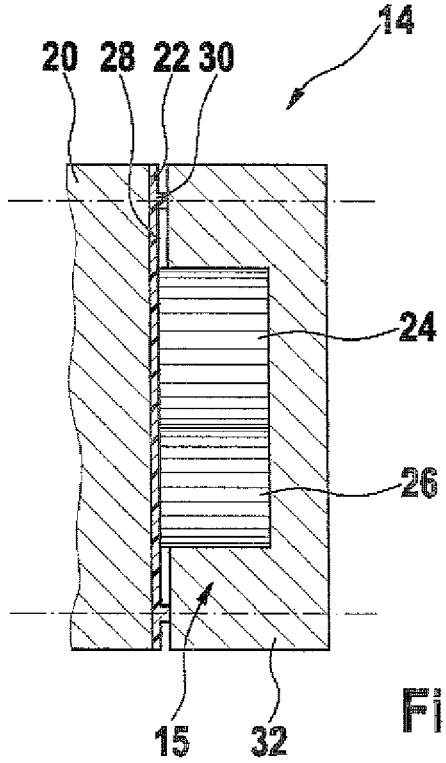
FIG. 3 is a schematic section through the region shown in FIG. 2.

As also seen from FIG. 3, a coating of a plastic, namely a thermoplastic, is applied to the housing region 22. This coating is shown in FIG. 2 by cross-hatching and is identified by reference numeral 28. The coating 28 is applied to the housing region 22 on its side toward the two gear wheels 24 and 26; that is, the two gear wheels 24 and 26 rest on the coating 28. Concretely, as a material for the coating 28, a polyether ether ketone can be considered. The coating 28 is melted onto the housing region 22. In an exemplary embodiment not shown, the coating can be additionally reinforced with fibers, in particular carbon fibers.

As seen from FIG. 3, the coating 28, outside the running face of the two gear wheels 24 and 26, has an encompassing sealing bead 30, which forms a sealing region that cooperates with another region, embodied as a cap 32, of the housing 20. The cap 32 is screwed onto the housing region 22, and upon assembly, the sealing bead 30 is compressed, and as a result, the region located radially inward from the sealing bead 30 is sealed off from the outside.

Figure 4:
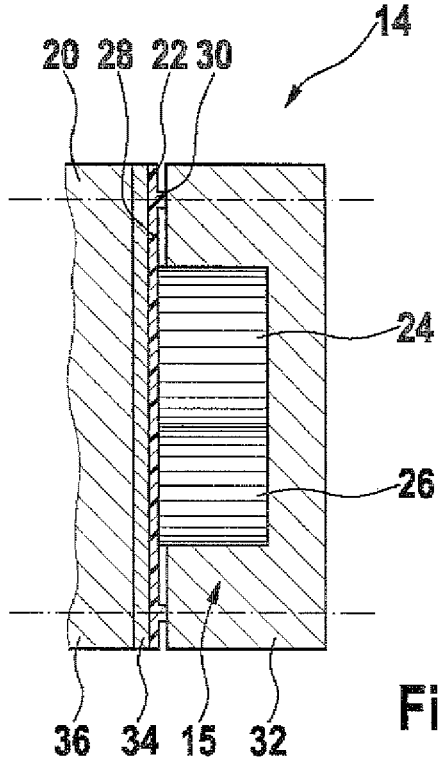
FIG. 4 is a view similar to FIG. 3 of an alternative embodiment.

An alternative embodiment is shown in FIG. 4. Those elements and regions that have equivalent functions to elements and regions that have already been described are identified by the same reference numerals. They will not be described again in detail.

In a distinction from the exemplary embodiment of FIGS. 2 and 3, the housing region 22 on which the coating 28 is applied includes a comparatively thin support plate 34, which is glued to a remaining housing 36 of the high-pressure fuel pump 14.

The foregoing relates to the preferred exemplary embodiments of the invention, it being understood that other variants and embodiments thereof are possible within the spirit and scope of the invention, the latter being defined by the appended claims.

The invention claimed is:

1. A fuel pump comprising:

a housing having a first housing member mounted to a second housing member, said first and second housing members defining an interior region having at least one interior surface, said first and second housing members further defining abutting surfaces therebetween when mounted together;

at least one part which is a moving part when in operation and which at least indirectly contacts said at least one interior surface; and a single-layer friction-reducing coating applied to said at least one interior surface and to said abutting surface of said first housing member, wherein the coating includes a plastic that extends between said at least one part and said at least one interior surface and between said abutting surfaces.

2. The fuel pump as defined by claim 1, wherein the plastic is a thermoplastic.

3. The fuel pump as defined by claim 2, wherein the thermoplastic is reinforced with fibers.

4. The fuel pump as defined by claim 1, wherein a material of at least a housing region onto which the coating is applied includes aluminum or is aluminum.

5. The fuel pump as defined by claim 2, wherein a material of at least a housing region onto which the coating is applied includes aluminum or is aluminum.

6. The fuel pump as defined by claim 3, wherein a material of at least a housing region onto which the coating is applied includes aluminum or is aluminum.

7. The fuel pump as defined by claim 1, wherein the coating extending between the abutting surfaces includes an encompassing sealing bead or an encompassing sealing lip.

8. The fuel pump as defined by claim 2, wherein the coating extending between the abutting surfaces includes an encompassing sealing bead or an encompassing sealing lip.

9. The fuel pump as defined by claim 3, wherein the coating extending between the abutting surfaces includes an encompassing sealing bead or an encompassing sealing lip.

10. The fuel pump as defined by claim 4, wherein the coating extending between the abutting surfaces includes an encompassing sealing bead or an encompassing sealing lip.

11. The fuel pump as defined by claim 1, wherein the coating is melted onto the housing surfaces.

12. The fuel pump as defined by claim 2, wherein the coating is melted onto the housing surfaces.

13. The fuel pump as defined by claim 3, wherein the coating is melted onto the housing surfaces.

14. The fuel pump as defined by claim 4, wherein the coating is melted onto the housing surfaces.

15. The fuel pump as defined by claim 5, wherein the coating is melted onto the housing surfaces.

16. The fuel pump as defined by claim 6, wherein the coating is melted onto the housing surfaces.

17. The fuel pump as defined by claim 2, wherein the plastic is a polyether ether ketone.

18. The fuel pump as defined by claim 3, wherein the thermoplastic is reinforced with carbon fibers.

19. A fuel pump comprising a housing having a first housing member, a second housing member, and a comparatively thin support plate mounted between said first and second housing members, said support plate and said first housing member defining an interior region, said support plate defining at least one interior surface, said support plate and second housing members defining abutting surfaces therebetween when mounted together;

at least one part which is a moving part when in operation and which at least indirectly contacts said at least one interior surface; and a single-layer friction-reducing coating applied to said at least one interior surface and to said abutting surface of said support plate, wherein the coating includes a plastic that extends between said at least one part and said at least one interior surface and between said abutting surfaces.

20. The fuel pump as defined by claim 19, wherein the plastic is a thermoplastic.

21. The fuel pump as defined by claim 20, wherein the thermoplastic is reinforced with fibers.

22. The fuel pump as defined by claim 19, wherein a material of at least a housing region onto which the coating is applied includes aluminum or is aluminum.

23. The fuel pump as defined by claim 20, wherein a material of at least a housing region onto which the coating is applied includes aluminum or is aluminum.

24. The fuel pump as defined by claim 21, wherein a material of at least a housing region onto which the coating is applied includes aluminum or is aluminum.

25. The fuel pump as defined by claim 19, wherein the coating extending between the abutting surfaces includes an encompassing sealing bead or an encompassing sealing lip.

26. The fuel pump as defined by claim 20, wherein the coating extending between the abutting surfaces includes an encompassing sealing bead or an encompassing sealing lip.

27. The fuel pump as defined by claim 21, wherein the coating extending between the abutting surfaces includes an encompassing sealing bead or an encompassing sealing lip.

28. The fuel pump as defined by claim 22, wherein the coating extending between the abutting surfaces includes an encompassing sealing bead or an encompassing sealing lip.

29. The fuel pump as defined by claim 19, wherein the coating is melted onto the housing surfaces.

30. The fuel pump as defined by claim 20, wherein the coating is melted onto the housing surfaces.

31. The fuel pump as defined by claim 21, wherein the coating is melted onto the housing surfaces.

32. The fuel pump as defined by claim 22, wherein the coating is melted onto the housing surfaces.

33. The fuel pump as defined by claim 23, wherein the coating is melted onto the housing surfaces.

34. The fuel pump as defined by claim 24, wherein the coating is melted onto the housing surfaces.

35. The fuel pump as defined by claim 30, wherein the plastic is a polyether ether ketone.

36. The fuel pump as defined by claim 21, wherein the thermoplastic is reinforced with carbon fibers.

* * * * *